US005414911A

United States Patent [19]

Adams

[11] Patent Number: 5,414,911

[45] Date of Patent: May 16, 1995

[54] ONE-PIECE CLAMP-TYPE CLIP

[75] Inventor: William E. Adams, Butler, Pa.

[73] Assignee: Adams Mfg., Portersville, Pa.

[21] Appl. No.: 159,675

[22] Filed: Nov. 30, 1993

[51] Int. Cl.[6] ..... A44B 21/00

[52] U.S. Cl. ..... 24/545; 24/507; 24/543; 24/557

[58] Field of Search ..... 24/543, 545, 562, 563, 24/511, 507, 489, 499, 518, 551, 570

[56] References Cited

U.S. PATENT DOCUMENTS

| | | | |
|---|---|---|---|
| D. 332,584 | 1/1993 | Tarro . | |
| 1,644,948 | 10/1927 | Poirier | 24/563 |
| 2,519,987 | 8/1950 | Wernette | 24/563 |
| 2,573,125 | 10/1951 | Wilks | 24/511 |
| 2,616,393 | 11/1952 | Rebarchek | 24/507 |
| 3,982,307 | 9/1976 | Smith et al. | 24/562 |
| 4,228,569 | 10/1980 | Snyder | 24/489 |
| 4,277,864 | 7/1981 | Orson, Sr. | 24/545 |
| 4,292,749 | 10/1981 | Thomas . | |
| 4,506,416 | 3/1985 | Ohminato et al. | 24/545 |
| 5,179,768 | 1/1993 | Jio | 24/545 |

FOREIGN PATENT DOCUMENTS

| | | | |
|---|---|---|---|
| 0242186 | 1/1961 | Australia | 24/545 |
| 0165200 | 11/1958 | Sweden | 24/557 |

*Primary Examiner*—Victor N. Sakran
*Attorney, Agent, or Firm*—Buchanan Ingersoll; Lynn J. Alstadt

[57] ABSTRACT

The present invention provides a clip that is one piece and is therefore relatively easy to fabricate. A resilient plastic such as polycarbonate is preferred so that fabrication is inexpensive and yet effective repetitive clamping of the clip is achieved. Furthermore, the closure ends of the clip are designed to overlap somewhat so that any semi-permanent deformation of the material or thermal contraction of the clip that would cause the closure ends of the clip to move away from one another will not act to diminish the effectiveness of the present clip.

10 Claims, 2 Drawing Sheets

FIG. 1
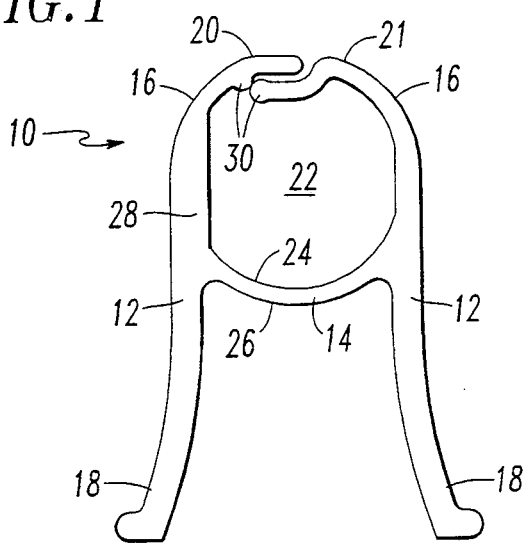
FIG. 2
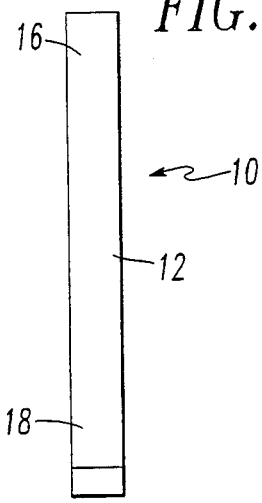
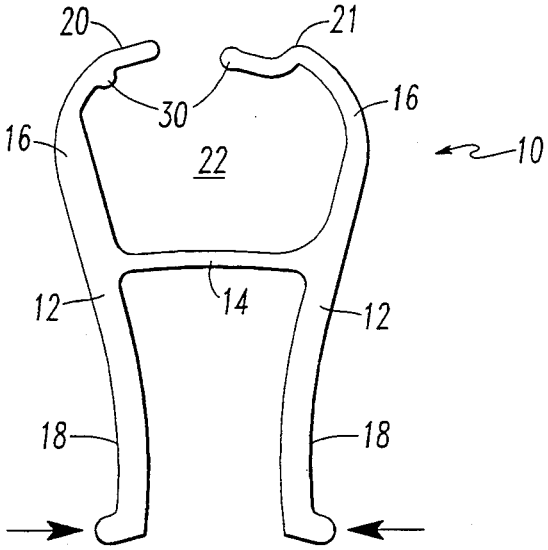
FIG. 3
FIG. 4
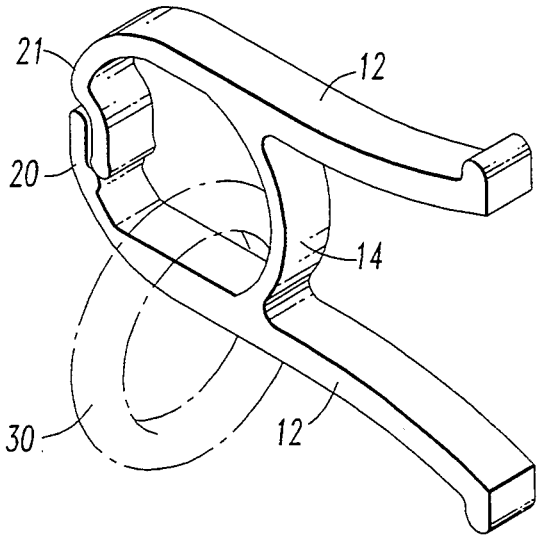

FIG. 5
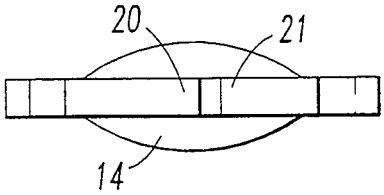
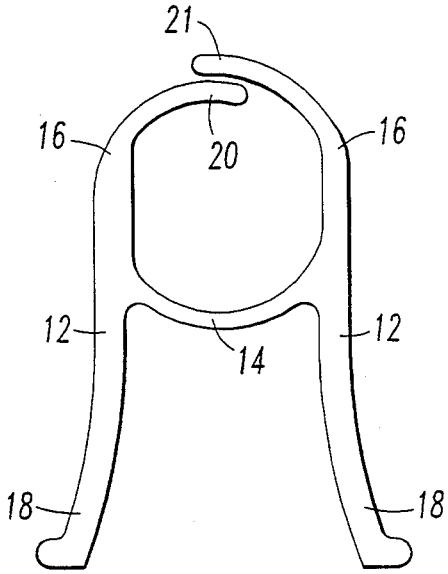
FIG. 6
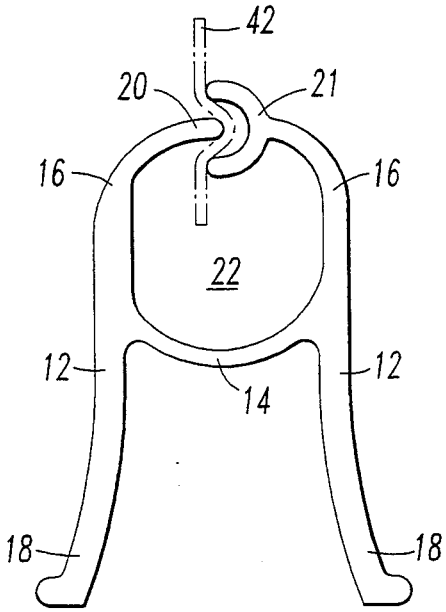
FIG. 7
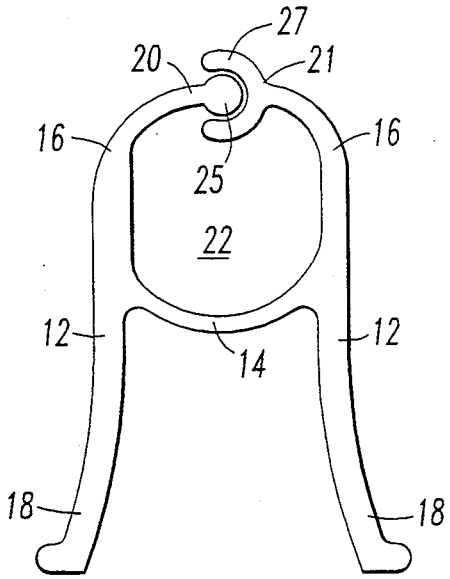
FIG. 7A
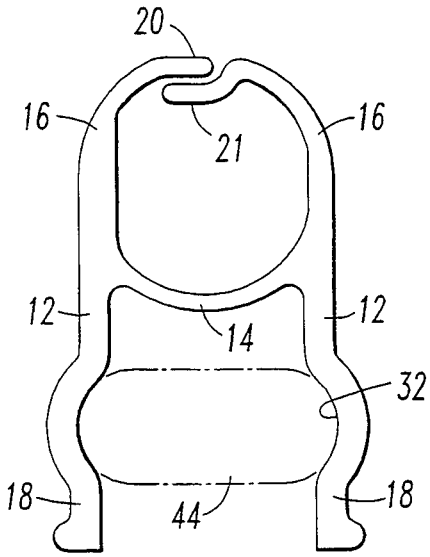
FIG. 8

ONE-PIECE CLAMP-TYPE CLIP

BACKGROUND OF THE INVENTION

1. Field of the Invention

This invention relates generally to the field of clips, and more particularly to lightweight, inexpensive one-piece clamp-type clips.

2. Description of the Prior Art

It is often desirable to-hold two or more objects together for a period of time and then take them apart. Such situations range from hanging clothes on a line, and hanging ornaments on a tree to keeping keys on a chain and clipping papers together. Clothes pins, ornament hooks, key chains and paper clips commonly used for these jobs are sometimes useful for other hanging or clipping applications. However, one piece clothes pins and hooks often do not provide secure placement of an article and are not versatile as they cannot grip articles. Chains will not hold a desired shape and paper clips often come loose.

Clamp-type clips are more secure than the above-mentioned types of clips. However, clamp-type clips are generally constructed of at least three pieces. Such clips have two sides or arms connected by a spring which exerts a force on the two arms causing the two arms to tend to come together at one end. Clamp-type clips require either pivotal connections to be molded on them or require a pin pivotally connecting them. Such multi-piece clips are relatively expensive to manufacture.

A one-piece clip which opens and closes like a clamp-type clip would be generally less expensive to manufacture than a three piece clamp-type clip. However, the art has not developed a one-piece clamp-type clip which will fully close after being opened. Many plastics are resilient. Yet, a certain amount of semi-permanent deformation will eventually occur with repetitive use of most materials including plastics. Because of this deformation, should one mold prior art clamp-type clips as one piece of plastic, the closure portions of the clip will fail to completely contact. Thus, there is a need for a one piece clip made from a sufficiently resilient material that is molded and configured so that the closure portions of the clip will return to a contacting closed position and provide sufficient clamping.

Many methods are known for mounting lightweight signs, ornaments, lighting and light bulbs (such as Christmas lighting) to a home or to a Christmas tree. Adhesive tape has been one such method used. However, tape can become ineffective as moisture tends to reduce the effectiveness of the tape's adhesive. Furthermore, some of the adhesive may remain on the surface after removal of the tape. In any event, adhesive tapes are non-reuseable. More permanent methods of hanging Christmas lighting and other ornaments involve affixing hooks into the structure of the house. Such hooks require the drilling or screwing of anchors or screw-like portions of the hooks into the structure. Therefore, these hooks must either be left in place permanently or be removed leaving permanent and unsightly holes in the structure surrounding the windows. Hooks for hanging Christmas ornaments and lighting to Christmas trees suffer the drawbacks described above for clips.

SUMMARY OF THE INVENTION

I provide a one-piece automatically-recloseable clip. I prefer to make the clip from a resilient material such as plastic, preferably a polycarbonate, so that fabrication is inexpensive and yet effective repetitive clamping of the clip is achieved.

The preferred clip is made of two opposed, elongated legs, and a bridge that is attached to and connects the two legs. The bridge is connected to each leg such that a lower section of each leg lies on one side of the bridge and an upper section of each leg lies to the other side of the bridge. The upper section of each leg terminates in a closure end that angles toward and overlaps the other closure end when the clip is in a closed position.

Thus, the upper sections of the legs terminating in closure ends, which may be thought of as jaws, together with the bridge define a holding area which is generally enclosed in a circumferential manner when the clip is in a closed position. Thus, objects having holes or openings therethrough may be placed around either the upper section of the legs or the bridge and be secured thereto when the clip is in a closed position. In addition to holding objects, the clip may be secured to a structure at its jaws. Thus, the clip may hold an object and secure that object to a gutter, a tree limb or a wire.

The clip is generally opened by squeezing or otherwise moving the two lower sections of the legs toward one another. When the opening force is applied to the lower sections of the legs, the bridge acts as a fulcrum spreading the closure ends of the upper sections of the legs away from one another. When the opening force is removed, the bridge acts as a spring for turning the closure ends of the legs toward one another in the closed position.

The bridge is preferably arcuate so as to have a concave surface bounding and directing toward the holding area of the clip. The spring-like properties of the bridge may be selectable by altering the dimensions of the bridge with respect to the remainder of the clip. Therefore, the bridge may be either thicker (greater depth) or wider or both than the remainder of the clip. In addition, the curvature of the bridge may be selectably changed to provide more or less closing force to the spring (bridge). In fact, the bridge may have several turns or curves in its shape.

Furthermore, the closure ends of the clip are designed to overlap somewhat so that any semi-permanent deformation of the material or thermal contraction of the clip that would cause the closure ends of the clip to move away from one another will not act to diminish the effectiveness of the present clip. The closure ends of the legs may be stepped, gradually curved or may be forked. In addition, bumps or surface irregularities may be provided on the closure ends to increase frictional contact between the closure ends and provide for more effective closing.

In addition to holding objects or being secured to a structure in the holding area of the clip, objects may be held between the lower sections of the legs when the clip is modified to have indents provided on the lower legs. The indents are curves in the lower sections of the legs of the clip so that the legs have concave sections opposed to one another. An object may then be provided between the two concave surfaces of the lower sections of the legs. Preferably, the dimensions of the clip with respect to the size of the object being held within the indents is such that tension may be provided by the lower sections of the legs to the object gripping the object therein while the closure ends of the clip remain in a closed position.

Other objects and advantages of the invention will become apparent from a description of certain present preferred embodiments thereof shown in the drawings.

BRIEF DESCRIPTION OF THE DRAWING

FIG. 1 is a front view of a first preferred embodiment of the present invention in the closed position.

FIG. 2 is a side view of the first preferred embodiment of the present invention.

FIG. 3 is a front view of the first preferred embodiment of the present invention in the open position.

FIG. 4 is a perspective view of the first preferred embodiment holding a ring.

FIG. 5 is a top view of a second preferred embodiment.

FIG. 6 is a front view of a third preferred embodiment of the present invention having a gradual overlapping closure configuration.

FIGS. 7 and 7A are front views of a fourth preferred embodiment of the present invention having a forked overlapping closure configuration.

FIG. 8 is a front view of a fifth preferred embodiment of the present invention having indents for holding an object therebetween.

DESCRIPTION OF THE PREFERRED EMBODIMENT

Referring first to FIGS. 1 and 2, the preferred embodiment of one-piece clip 10 has two opposed elongated legs 12. A bridge 14 connects the two legs 12. The two legs 12 each have an upper section 16 located at one side of bridge 14. Likewise, legs 12 each have a lower section 18 located to the side of bridge 14 opposite to the upper section 16. Each upper section 16 of legs 12 angle back toward the opposed legs 12. These portions of each upper section 16 are called the closure ends 20 and 21. When no external forces are acting upon one-piece clip 10, clip 10 is in a closed position as shown in FIG. 1. Ends 20 and 21 are designed so that when clip 10 is in a closed position, a portion of end 20 overlaps end 21. A holding area 22 is formed that is bounded by the bridge 14, the upper section 16 of such leg 12 and the overlapping ends 20 and 21 assure that holding area 22 is completely bounded by clip material when clip 10 is in this closed position.

Referring next to FIG. 3, when an external force (shown by the bold arrows) is applied to clip 10 so as to cause lower sections 18 of each leg 12 to be moved toward one another (hereinafter referred to as the opening force), bridge 14 acts to allow upper sections 16 and hence overlapping ends 20 and 21 to move away from one another. In this manner, legs 12 act as levers with bridge 14 serving as a fulcrum. Once overlapping ends 20 and 21 are moved away from one another so that holding area 22 is no longer bounded completely by clip material, clip 10 is in the open position and ready to accept or release objects or be secured or removed from a structure.

It is preferred that the width of bridge 14 be slightly less than the width of legs 12 so that flexure will occur at bridge 14. In the first preferred embodiment, the clip 10 is of uniform depth as seen in FIG. 2. Bridge 14 is preferably arcuate rather than being perfectly straight, having a concave surface 24 that faces towards the ends 20 and 21, and thus bounds the holding area 22. Bridge 14, therefore, also has a convex surface 26 that faces away from holding area 22.

When an opening force is applied, bridge 14 is temporarily deformed. During the application of the opening force, concave surface 24 is expanded in length and convex surface 26 is compressed. When bridge 14 is thus in a state of flexure, the ends 20 and 21, which act like jaws, are open. In this open position, an object having an opening or hole therethrough, such as ring 40 shown in FIG. 4, may readily pass from outside holding area 22 to inside holding area 22. Bridge 14 will remain in flexure and the clip will thus be open for as long as the opening force is applied. Bridge 14 is elastic and hence acts as a spring in that when deformed in one direction, bridge 14 exerts a force opposing the deformation. Thus, once the opening force is no longer applied, bridge 14 will return to its original shape putting clip 10 back in a closed position.

Referring again to FIG. 1, to further assist clip 10 in returning to its original closed position a web 28 is provided in at least one upper section 16 of a leg 12. Web 28 provides a thicker section of material and because of the increased thickness of web 28, it will incur increased shrinkage upon cooling. This increased shrinkage causes a natural tendency for web 28 and closure portion 20 to move to a closed position. Web 28 may be curved or may be relatively straight.

A number of possible materials could be chosen for one-piece clip 10. However, polycarbonate is preferred as it exhibits good elastic qualities, is sufficiently strong, and is relatively inexpensive.

In manufacturing the clip, I have discovered certain advantages from molding the clip at an elevated material temperature. Polycarbonate is normally molded at 400° F., however, if the clip is molded at a higher temperature such as about 600° F., the material will experience increased cooling and thus increased shrinkage. In the present clip, this increased shrinkage causes ends 20 and 21 to be drawn closer together than if the clip was molded at the standard temperature. I have also observed that as the width of the clip at a given segment is increased, the amount of shrinkage incident to that segment increases as well. The increased volume of web 28 allows it to be more contracted initially thus providing improved closure and improved ability for the clip to return to a closed position once opened.

Referring to FIG. 5, the thickness or depth of bridge 14 could be extended so as to offer the improved ability of ends 20 and 21 to return to their original closed positions.

There are a number of factors which could cause ends 20 and 21 to fail to return to a fully closed position immediately after the opening force is removed. A temperature change can cause the material of clip 10 to expand or contract causing ends 20 and 21 to be moved away from one another. Also, the application of the opening force could cause strain in the material of the clip. Furthermore, there may simply be a time delay in the material returning to its original shape. All these types of situations which result in ends 20 and 21 failing to return to a fully closed position immediately after the opening force is removed shall be hereinafter referred to as semi-permanent deformation. The amount of semi-permanent deformation that can occur with clip 10 still being able to regain a closed position should be equal to the amount of overlap designed in the ends 20 and 21.

Several configurations are advantageous for the overlap of the ends 20 and 21 that enable holding area 22 to remain bounded by clip material despite the presence of some semi-permanent deformation. One possible overlap configuration shown in FIG. 1 is a stepped overlap. In this design, one end 20 is evenly arced and the opposed end 21 has a step or bend in it. The step allows a predetermined amount of end 21 to be adjacent and roughly parallel to a predetermined amount of end 20 when clip 10 is in the closed position. A stepped overlap offers the advantage of ends 20 and 21 not contacting one another during closing. Such contact can create a friction force that could inhibit full closure. It is also preferred that in the stepped closure end embodiment that the stepped closure end 21 be closest to the holding area 22. When clip 10 is hung onto a structure such as a line or a cord and has a heavy object secured thereupon, the weight of the object will tend to pull the clip down away from the structure. Having the structure contacting the clip 10 at stepped closure end 21 will help prevent the closure end 20, 21 from spreading and opening.

Another possible closure configuration, shown in FIG. 6, has ends 20 and 21 that gradually overlap without a step. In this design, one end 20 is evenly arced and the opposed end 21 is also evenly arced but has a larger radius of curvature. Thus, a predetermined portion of end 21 overlaps a predetermined portion of end 20 when clip 10 is in the closed position. The gradually overlapping ends are generally effective and are easy to manufacture.

Referring next to FIGS.7, and 7A yet another closure configuration utilizes a forked end. In this design, one end 20 is evenly arced and the opposed end 21 has two arms so as to fork around end 21. Both arms are adjacent to a predetermined amount of end 20 on opposite sides of end 20 when clip 10 is in the closed position. In addition to holding objects in holding area 22, this configuration is particularly well-suited for gripping flat objects (shown as 42 in FIG. 7) such as a sheet of paper. Or a roofing shingle. The shape or length of the upper section could be changed to accomodate the selected object. This gripping action comes from the elastic material of clip 10 resisting deformation in the open direction thus exerting a force tending to return clip 10 to a closed position. An enlarged head 25 and mating socket 27 could be provided as shown in FIG. 7A to enable the arms to lock. Referring again to FIG. 1, surface irregularities or bumps 30 may be provided on any closure configuration to improve the closure function. Bumps 30 provide extra clip material that acts as a barrier to prevent an object being held within holding area 22 to exit between closure ends 20 and 21 before the appropriate opening force is applied. Bumps 30 help provide added surface friction between closure end 20 and closure end 21 so as to help retain clip 10 in a closed position. Although two bumps 30 are shown, any number of bumps can be employed.

In addition to those features mentioned above, the clip 10 may be modified in an embodiment shown in FIG. 8 to grip an object 44. In this embodiment, indents 32 are provided on the lower sections 18 of respective legs 12. The indents 32 are curved provided along the lower sections 18 of the legs 12 so as to have concave surfaces facing one another. Thus, an object 44 may be held within and between the two indents 32. The relative curvature of the curved indents 32 as well as the distance between the indents 32 may be selectably changed so as to better hold either a more rounded/square object 44 or a more flat/oval object 44. Preferably, the clip 10 and particularly indents 32 are sized and configured so that when an object 44 is provided within the indents 32, the clip 10 is in the closed position. Preferably when an object 44 is provided within indents 32, indents 32 will tend to be moved away from one another by the object. Thus, closure ends 20, 21 will tend to be moved toward one another, further into the closed position. Bridge 14 will also cause lower sections 18 of the leg 12 to tend to grip the object 44. With the object 44 thus gripped, the clip 10 will be in the closed position.

Although bridge 14 is shown as being arcuate, the bridge could be essentially straight or have varying curvature and still accomplish its functions. Similarly, although upper sections 16 and ends 20 and 21 are shown as being arcuate, any preferred shape of the turn could be chosen such as a squared turn.

While certain present preferred embodiments have been shown and described, it is distinctly understood that the invention is not limited thereto but may be otherwise embodied within the scope of the following claims.

I claim:

1. A one-piece, automatically recloseable clip made of a resilient material comprising:

(a) two elongated legs, each leg having an arcuate upper section terminating in a closure end and a lower section, the closure end of one leg having a step, the legs being shaped and positioned so that a portion of the closure end having the step will overlap and be generally parallel to a portion of the closure end of the other leg and the lower section of each leg will be spaced apart from one another when the clip is in a closed position, wherein the lower sections of the legs have respective concave indents thereupon, the indents being sized and configured for holding a rounded object therebetween, wherein the clip is in the closed position when the object is provided within the indent; and (b) a bridge attached at its ends to and connecting the elongated legs, each end being attached between the upper section and the lower section of a leg.

2. The one-piece clip of claim 1 wherein the bridge is arcuate.

3. The one-piece clip of claim 1 wherein the clip is fabricated from a plastic.

4. The one-piece clip of claim 3 wherein the clip is molded at a temperature of about 600° F.

5. The one-piece clip of claim 1 wherein one closure end is stepped to overlap the other closure end.

6. The one-piece clip of claim 1 wherein one closure end gradually overlaps the other closure end.

7. The one-piece clip of claim 1 wherein one closure end has a fork shape and the other closure end fits within the fork shape in the closed position.

8. The one-piece clip of claim 1 also comprising at least one bump provided on at least one of the closure ends.

9. The one-piece clip of claim 1 also comprising a web on at least one of the upper sections of the legs.

10. The one-piece clip of claim 1 wherein the upper sections of each leg is arcuate.

* * * * *